US009534462B2

(12) United States Patent
Hayter

(10) Patent No.: US 9,534,462 B2
(45) Date of Patent: Jan. 3, 2017

(54) SUPPORT CONE FOR RETRIEVABLE PACKER

(71) Applicant: BAKER HUGHES INCORPORATED, Houston, TX (US)

(72) Inventor: Steven R. Hayter, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 222 days.

(21) Appl. No.: 14/466,654

(22) Filed: Aug. 22, 2014

(65) Prior Publication Data

US 2016/0053563 A1 Feb. 25, 2016

(51) Int. Cl.
*E21B 23/06* (2006.01)

(52) U.S. Cl.
CPC ..... *E21B 23/065* (2013.01); *E21B 23/06* (2013.01)

(58) Field of Classification Search
CPC ..... E21B 23/06
See application file for complete search history.

(56) References Cited

U.S. PATENT DOCUMENTS

| | | | | |
|---|---|---|---|---|
| RE26,379 | E * | 4/1968 | Cochran et al. | E21B 33/1295 166/120 |
| 5,636,689 | A * | 6/1997 | Rubbo | E21B 23/06 166/123 |
| 6,481,497 | B2 | 11/2002 | Swor et al. | |
| 7,222,669 | B2 | 5/2007 | Sonnier et al. | |
| 2004/0244966 | A1 | 12/2004 | Zimmerman et al. | |
| 2012/0285684 | A1 | 11/2012 | Crow et al. | |
| 2015/0292284 | A1 * | 10/2015 | Lemm | E21B 33/1291 166/216 |

* cited by examiner

*Primary Examiner* — Jennifer H Gay
*Assistant Examiner* — Steven MacDonald
(74) *Attorney, Agent, or Firm* — Steve Rosenblatt

(57) ABSTRACT

Opposed cones for slips on a packer have an annular undercut in general alignment with the end of the cone that has the slip ramp. The undercut faces the mandrel on which the cones can be driven together to radially extend the slips. A high modulus insert sleeve is interference fitted to the undercut. This results in the cone exterior surface being in hoop stress tension before the slips are set. Once the slips are set and a reaction load comes radially back from the surrounding tubular into which the slips have extended there is a tendency for the reaction force to put the exterior surface of the cones into compressive hoop stress. The initial tensile hoop stress from the sleeve placement acts to at least in part offset the reaction force tending to create compressive hoop stress. The net loading and deflection of the mandrel is minimized.

21 Claims, 1 Drawing Sheet

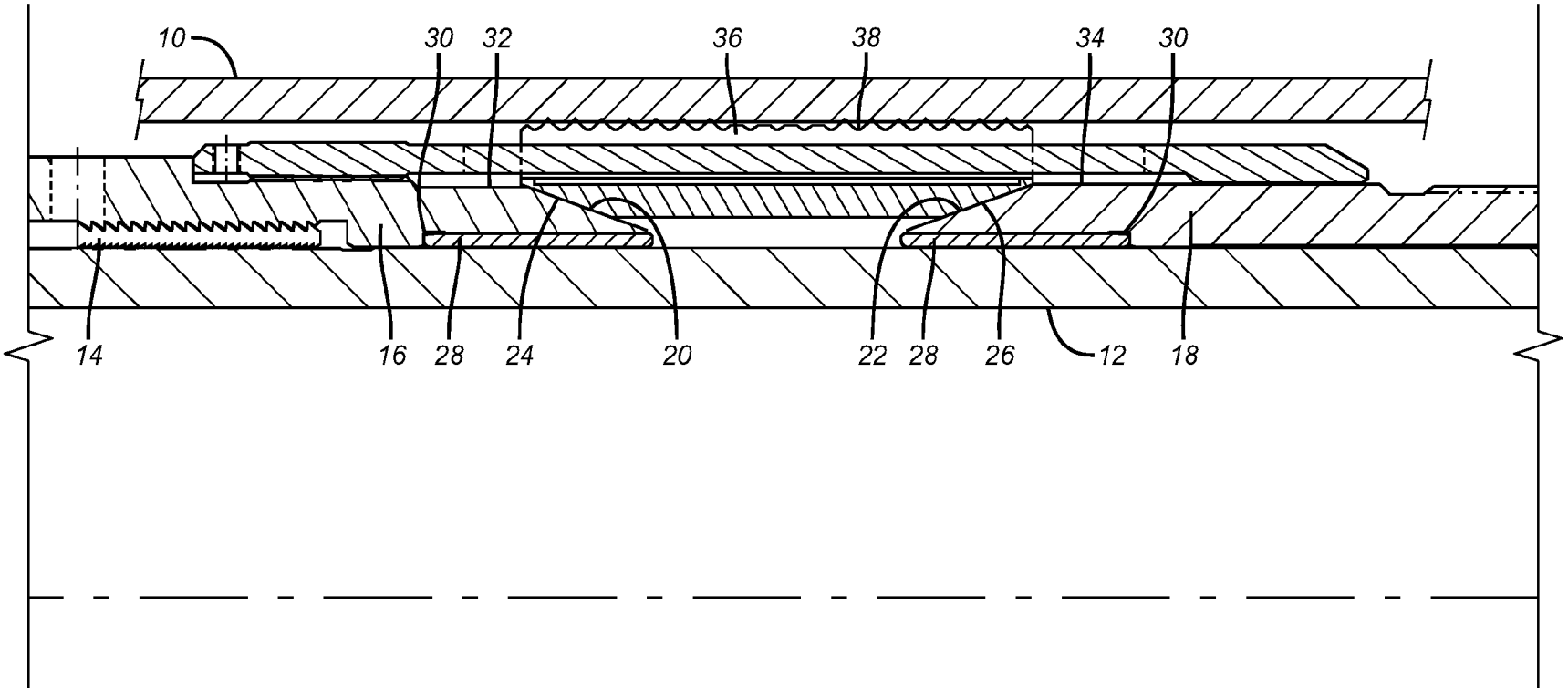
30
34
38
36
32
30
10
18
12
26
28
22
20
24
28
16
14

SUPPORT CONE FOR RETRIEVABLE PACKER

FIELD OF THE INVENTION

The field of the invention is retrievable packers and more particularly where the setting occurs with single ramp cones advancing under slips to push them out to the surrounding tubular for an anchoring grip.

BACKGROUND OF THE INVENTION

Retrievable packers typically have a sealing system and anchoring slips that are set in a variety of ways including axial compression with a setting tool. There is generally a lock to hold the set position to allow the setting tool to be released. Release of the packer involves defeat of the locking system that can occur with a predetermined applied force or even cutting the mandrel in two. When the slip or slips are extended to the surrounding tubular for the anchoring function there is a reaction force from the surrounding tubular radially back through the slips. Depending on the slip system design the reaction force can go circumferentially into a slip ring, as in US 2004/0244966; into an adjacent slip circumferentially when slip segments make a continuous ring, as in U.S. Pat. No. 7,222,669; or into the mandrel through a cone that has a plurality of ramps as in US2012/0285684. Barrel slips are cylindrically shaped cohesive structures that can take radial reaction load and spread it circumferentially especially when used with multi-ramped drive cones. Barrel slips are shown in FIG. 4 of U.S. Pat. No. 6,481,497.

Other designs that use opposed single ramp cones that are brought together under opposed ends of slip segments have a unique way of directing the reaction force from the surrounding tubular when the slips are set radially into the actuation cones. What can happen is that the reaction force can be so great as to cause the mandrel beneath the cones to plastically deform if not collapse. This issue could be addressed with a thicker wall on the mandrel but then the price of that design choice is a much smaller passage through the mandrel for production. Another approach is to make the mandrel of rather high modulus materials but then in the event of a need to mill out the packer for any reason the milling becomes problematic or protracted. Similarly space constraints often limit the cone thickness that can be used between the mandrel and the slips and making a thicker cone will generally mean having to make other parts thinner to offset the cone dimension increase. Doing this creates pressure rating issues for the mandrel or else a smaller through bore needed to regain a desired pressure rating.

What is needed and provided by the present invention is a simple way to offset reaction force so as to minimize loading on the mandrel that can lead to undesirable deformation of the mandrel. In essence a sleeve is interference fit in the cone so that the fitment results in tensile hoop stress at the cone outer surface when running in. As the packer is set and the reaction force comes from the surrounding tubular through the slips and cones there is a tendency to place the outer cone surface in compression hoop stress. The initial hoop tension from the interference fitted sleeve offsets the compression hoop stress component resulting from the reaction force thereby minimizing the stress transmitted to the mandrel from the cone. These and other aspects of the present invention will be more readily apparent to those skilled in the art from a review of the description of the preferred embodiment and the associated FIGURE while recognizing that the full scope of the invention is to be determined from the appended claims.

SUMMARY OF THE INVENTION

Opposed cones for slips on a packer have an annular undercut in general alignment with the end of the cone that has the slip ramp. The undercut faces the mandrel on which the cones can be driven together to radially extend the slips. A high modulus insert sleeve is interference fitted to the undercut. This results in the cone exterior surface being in hoop stress tension before the slips are set. Once the slips are set and a reaction load comes radially back from the surrounding tubular into which the slips have extended there is a tendency for the reaction force to put the exterior surface of the cones into compressive hoop stress. The initial tensile hoop stress from the sleeve placement acts to at least in part offset the reaction force tending to create compressive hoop stress. The net loading and deflection of the mandrel is minimized.

BRIEF DESCRIPTION OF THE DRAWING

The FIGURE illustrates a section view of a slip cone pair showing the sleeve with the slips in the set position.

DETAILED DESCRIPTION OF THE PREFERRED EMBODIMENT

The FIGURE illustrates a tubular 10 in which the tool is inserted on a mandrel 12 attached to a delivery string that is not shown. Also not shown are the seal assembly for the packer that is well known to those skilled in the art. What is shown is the lock ring assembly 14 that is also commonly used in such compression set packers or packers set in other ways such as hydraulically or with string manipulation to name a few examples. Opposed cones 16 and 18 have opposed facing tapers 20 and 22. Slip ends 24 and 26 ride on ramps or tapers 20 and 22. Sleeves 28 are inserted in cones 16 and 18 in an undercut 30. Each sleeve is between the mandrel 12 and the body of the respective cone and is pressed into its respective undercut in an interference fit so that the ramps 20 and 22 and the outer surfaces 32 and 34 are put into a tensile hoop stress condition before the slips 36 extend into contact with the tubular 10 at wickers 38. When the slips 36 contact the tubular 10 there is a reaction force in the radially inward direction from the tubular 10 and through the slips 36 and into the cones 16 and 18. This reaction force tends to put the ramps 20 and 22 as well as the outer surfaces 32 and 34 in a condition of compressive hoop stress. The idea is that fitment of the sleeves 28 to create the initial tensile hoop stress before the slips 36 are set will partially offset the amount of compressive hoop stress in that same region than what would have been there but for the sleeves 28. Because of that the resulting load transferred to the mandrel 12 is reduced and therefore the tendency of the mandrel 12 to deform or crack is reduced. This setup can allow higher setting forces to be used or alternatively thinner walled mandrels that can allow the interior passage in the mandrel to be larger to enhance production or injection flow, depending on the application. Ideally, the sleeves 28 should extend to the respective ramp bottoms and can extend axially beyond the opposite end of each ramp about the axial length such ramps. The sleeves 28 can be far stiffer than the adjacent cones in which they are press fit. While the packer might have to be milled out, the small radial profile of the sleeve 28 which can have about a fourth of the thickness of the cone in which it is mounted or less, would not materially impede the milling time. Optionally the sleeve 28 can be rotationally locked to the respective cone so as to prevent relative rotation during milling. This can be accomplished in a variety of ways such as an exterior milled flat on the sleeve and a matching flat on the cone in which it is mounted. Another way could be a castellated pattern on the end of the sleeve that matches a pattern on the cone that is at the bottom of the undercuts 30. The sleeve material can be a cobalt tungsten carbide alloy. The sleeve 28 starts out in a compressed hoop stress state and that stress increases with the set. The high strength of the sleeve can tolerate such increased compressive stress. The presence of the sleeve helps reduce the stress on the cone and the mandrel as the forces are distributed over a larger portion of the mandrel using the sleeve to then reduce the stress on the mandrel. A modulus of elasticity for the sleeve 28 can be 60E6 PSI to reduce its deflection and to help reduce the resulting deflection of the mandrel.

The sleeve can have a higher coefficient of thermal expansion than the cone to which it is mounted. Doing so can reduce the initial interference fit for mounting the sleeve while still taking advantage of thermal effects in the borehole to add to the tensile hoop stress in the cones before the slips engage the surrounding tubular.

The above description is illustrative of the preferred embodiment and many modifications may be made by those skilled in the art without departing from the invention whose scope is to be determined from the literal and equivalent scope of the claims below:

I claim:

1. A tool for subterranean use, comprising:
a mandrel;
an anchoring assembly further comprising at least one cone selectively movable between at least one slip and said mandrel and at least one sleeve fitted to said cone in a manner to put a tensile hoop stress on at least one exterior surface of said cone before said slip is moved against a surrounding tubular.

2. The tool of claim 1, further comprising:
a radially extendable seal mounted to said mandrel to selectively engage a surrounding tubular.

3. The tool of claim 1, wherein:
said sleeve contacting said mandrel and said cone during loading.

4. The tool of claim 1, wherein:
said sleeve is stiffer than said cone or has a higher compressive yield strength than the cone.

5. The tool of claim 1, wherein:
said sleeve is mounted in an undercut between said cone and said mandrel.

6. The tool of claim 5, wherein:
said undercut is in said cone.

7. The tool of claim 1, wherein:
said sleeve is rotationally locked to said cone.

8. The tool of claim 1, wherein:
said sleeve underlies at least a ramp on said cone.

9. The tool of claim 8, wherein:
said sleeve extends from a bottom of said ramp and axially beyond a top of said ramp for a length at least as long as the axial length of said ramp.

10. The tool of claim 1, wherein:
said sleeve has a modulus of elasticity of at least 60E6 PSI.

11. The tool of claim 1, wherein:
said at least one cone comprises two spaced apart opposed cones with ramps facing each other;
said at least one sleeve comprises two sleeves, each of said cones being associated with one of said sleeves.

12. The tool of claim 1, wherein:
said sleeve is no more than a quarter the maximum thickness of said cone.

13. The tool of claim 1, wherein:
said sleeve reduces stress on the mandrel when said slip engages the surrounding tubular by transmitting force to a larger area on said mandrel that has been reduced by the initial tensile hoop stress on said cone initially applied by said sleeve.

14. A tool for subterranean use, comprising:
a mandrel;
an anchoring assembly further comprising at least one cone selectively movable between at least one slip and said mandrel and at least one a sleeve fitted to said cone in a manner to put a tensile hoop stress on at least one exterior surface of said cone before said slip is moved against a surrounding tubular;
said sleeve is interference fit within said cone.

15. A tool for subterranean use, comprising:
a mandrel;
an anchoring assembly further comprising at least one cone selectively movable between at least one slip and said mandrel and at least one a sleeve fitted to said cone in a manner to put a tensile hoop stress on at least one exterior surface of said cone before said slip is moved against a surrounding tubular;
said tensile hoop stress created by placement of said sleeve is offset with compressive hoop stress from a reaction force from the surrounding tubular when said slip is forced against the surrounding tubular by said cone.

16. The tool of claim 15, wherein:
said sleeve is stiffer than said cone or has a higher compressive yield strength than the cone.

17. The tool of claim 16 wherein:
said sleeve is mounted in an undercut between said cone and said mandrel.

18. The tool of claim 17, wherein:
said undercut is in said cone.

19. The tool of claim 18, wherein:
said sleeve is rotationally locked to said cone.

20. The tool of claim 15, wherein:
said sleeve is interference fit within said cone.

21. A tool for subterranean use, comprising:
a mandrel;
an anchoring assembly further comprising at least one cone selectively movable between at least one slip and said mandrel and at least one a sleeve fitted to said cone in a manner to put a tensile hoop stress on at least one exterior surface of said cone before said slip is moved against a surrounding tubular;
said sleeve has a higher coefficient of thermal expansion than said cone.

* * * * *